US006352218B1

(12) United States Patent
Holmqvist et al.

(10) Patent No.: US 6,352,218 B1
(45) **Date of Patent: *Mar. 5, 2002**

(54) METHOD AND DEVICE FOR A FIN-STABILIZED BASE-BLEED SHELL

(75) Inventors: Ulf Holmqvist; Ulf Hellman; Stig Johnsson, all of Karlskoga (SE)

(73) Assignee: Bofors Defence Aktiebolag, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/381,518

(22) PCT Filed: Mar. 11, 1998

(86) PCT No.: PCT/SE98/00438

§ 371 Date: Nov. 2, 1999

§ 102(e) Date: Nov. 2, 1999

(87) PCT Pub. No.: WO98/43038

PCT Pub. Date: Oct. 1, 1998

(30) Foreign Application Priority Data

Mar. 25, 1997 (SE) ..... 9701091

(51) Int. Cl.[7] ..... F42B 10/14; F42B 10/32

(52) U.S. Cl. ..... 244/3.29; 102/490

(58) Field of Search ..... 102/374, 376, 102/489, 490; 244/3.27–3.3

(56) References Cited

U.S. PATENT DOCUMENTS 4,498,394 A * 2/1985 Regebro ..... 102/490
4,546,940 A * 10/1985 Andersson et al. ..... 244/3.29
4,699,334 A * 10/1987 Boeder ..... 244/3.29
4,736,908 A * 4/1988 Boder ..... 244/3.29
4,944,226 A * 7/1990 Wedertz et al . ..... 102/476
5,103,734 A * 4/1992 Arnaud et al. ..... 102/489
5,140,909 A * 8/1992 Pineau et al. ..... 102/489

FOREIGN PATENT DOCUMENTS

SE 339646 B 10/1971
SE 432670 B 4/1984
SE 442782 B 1/1986

* cited by examiner

*Primary Examiner*—Harold J. Tudor
(74) *Attorney, Agent, or Firm*—Connolly Bove Lodge & Hutz, LLP

(57) ABSTRACT

The present invention relates to a method and a device designed for use with such shells (1) that are equipped with a base-bleed unit (8) for extended range and which during the first phase of their trajectory are spin-stabilised but which in the subsequent phase are subjected to spin deceleration by fins (9–13) that deploy from the shell body and take over the stabilising function. More exactly the present invention is a method and a device that enables the said shells (1) to achieve an effective and functional deployment of the fins (9–13) at the desired point in time with simultaneous ejection of the base-bleed unit (8) which at this point in time either no longer performs any useful function since it is burnt-out and solely constitutes a dead-weight or its function is no longer required. The basic idea behind the present invention is that the base-bleed unit (8) and the fin protector (19) that initially surrounds the fins (9–13) shall be permanently integrated with each other and thereby can be removed/ejected as a single unit.

5 Claims, 4 Drawing Sheets

METHOD AND DEVICE FOR A FIN-STABILIZED BASE-BLEED SHELL

Figure 1:
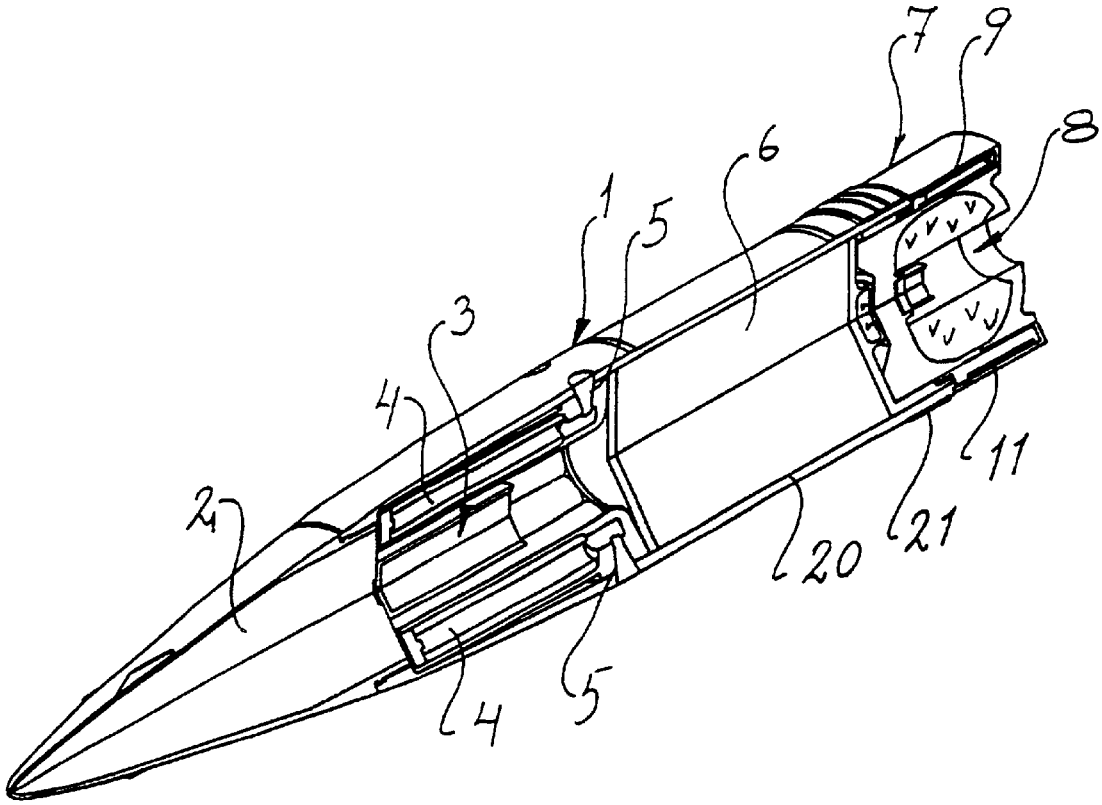

The present invention relates to a method and a device for shells incorporating base-bleed for extended range and which during the first phase of their trajectory are spin stabilized but which in a subsequent phase are subjected to spin deceleration when fins that are initially retracted deploy to assume the stabilization function. The present invention involves a method and a device that enables the said shells to achieve an effective and functional fin deployment with a simultaneous ejection of the base-bleed unit at the point in time when the switch to fin stabilization is desired with regard to the function of the shell, e.g. guidance to the target. By ejecting the base-bleed unit the shell is freed of extra weight that reduces its guidability at the same time as the center of gravity of the shell is shifted forwards towards the nose section which is advantageous for fin-stabilized shells. A preferred variant of the present invention also enables the location of the driving band on the shell to be freely selected for optimal functionality which, in most cases, would probably be forward of the deployable fins.

Artillery shells are usually spin-stabilized throughout their trajectory until impact with the target or self-detonation. There are also, however, numerous types of special shells that are spin-stabilized during the firing phase in the gun barrel but whose rate of spin is subsequently decelerated at an earlier or later stage in their trajectory when the stabilising function is taken over by the fins that deploy from the shell. This applies, for example, to terminally guided shells whose projectile trajectories can be corrected by means of command activated thrusters, deployable deceleration devices or the equivalent. It is, namely, much more difficult to correct the trajectory of a purely spin-stabilized body by external means than to perform an equivalent trajectory correction for a fin-stabilized body.

A spin-stabilized shell usually displays smaller trajectory deviations than an equivalent fin-stabilized shell. Moreover, the fin-stabilized shell has a greater air resistance resulting in shorter range, and is more affected by wind conditions.

As indicated above the present invention relates to the special conditions that apply when such shells that during firing and the major part of their trajectory are fin-stabilized and which incorporate a base-bleed unit for extended range and which, furthermore, towards the end of their trajectory have their rate of spin decelerated at the same time as they become fin-stabilized when their built-in stabilizing fins are deployed.

A number of different design principles already exist for projectiles with various types of deployable fins.

In the purely theoretical type of retractable fins each fin is initially retracted radially in the projectile body or, perhaps more usually, retracted in a dedicated slot or compartment in the projectile body. For the actual deployment function in which the fins flip up or spring up radially there are usually springs incorporated for this purpose. The major disadvantages with this type of fin is that they occupy too much space in the projectile body, and that it is difficult to provide them with sufficient surface area.

A type of fin that occupies significantly less space is the type which initially, i.e. prior to deployment, is retracted snugly curved against and around the projectile body and which, after they are exposed by the ejection of a protector or the opening of a special retaining device or suchlike, flip up primarily as the result of centrifugal forces and are thereafter locked in deployed mode. An example of this type of fin, in which the fin retains its convex shape even after deployment, is Swedish patent no. 339646. However, provided one selects the correct material it is possible to manufacture fins which become virtually flat after deployment despite having been retracted against the shell body on which they are installed for a number of years. With this type of fin the surface area of the fin usually poses no problem, but on the other hand it is essential to protect the fins while in retracted mode from the gas pressure in the barrel during firing of the projectile. If the fins were subjected to the full force of the gas pressure in the barrel in most cases this would result in such deformation of the fins that their function as stabilizing devices for the shell would be at risk, not to mention whether deployment itself would still be possible after such deformation. A solution to this secondary problem is described in conjunction. with the appended example.

The combination of deployable fins and ejectable base-bleed unit is in Swedish patents Nos 7908002-4 and 8200312-0. In both these cases the fins are deployed in conjunction with ejection of the base-bleed unit, and the location of the fins forward of the shell driving band protects them from the full force of the gas pressure during firing. Although this appears to be a natural solution to the problem it can, however, not always be used as it is often other criteria that determine where the driving band shall be located along the length of the shell (projectile). Since the shell is subjected to its greatest load forces precisely at the cross-section through the driving band it is necessary to ensure that the shell is highly resistant to deformation at this cross-section. A further complication is involved if the shell is intended for dispersing bomblets/submunitions and thus must be openable, which in most cases means that the base of the shell must enable the bomblets/submunitions to be dispersed.

The purpose of the present invention is to offer a method and a device enabling simultaneous fin deployment and ejection of the base-bleed unit for shells incorporating a base-bleed unit and which are fin-stabilized in the first phase of their trajectory but which in a subsequent phase have their rate of spin retarded by fins deployed from the shell body, which fins after spin retardation take over the stabilizing function.

This complete dual function sequence as specified in the present invention is achieved by a single small gas generating charge that is ignited by a control command, which charge ejects the base-bleed unit from inside the tail unit of the shell and simultaneously ejects a fin protector that is mechanically joined to the base-bleed unit and which concentrically surrounds the shell tail unit in which the fins are mounted and against which they are convexedly retracted initially. The union between the base-bleed unit and the fin protector is the aft wall that during firing forms the base of the shell, while there is a ring-shaped space between the base-bleed unit and the fin protector which houses the actual tail unit of the shell in which the fins are mounted and retracted ready for deployment as soon as the fin protector is ejected. When the base-bleed unit is ejected out of its location in the tail unit of the shell, the fin protector is thus also removed and the fins are free to deploy.

As a rule the fins of fin-stabilized projectiles are angled a few degrees relative to the longitudinal axis of the projectile to impart an inherent low rate of spin to the fin-stabilized projectile. Such a slight angling of the fins may also be incorporated in the above indicated type where initially the fins are retracted convexedly against the projectile body, but when deployed have virtually flat surfaces. The same effect can also be achieved by slightly angling the pivot pin of each fin relative to the longitudinal axis of the projectile.

A special advantage of this method and device as described in the present invention is achieved with the version of the invention in which the space between the fin protector and base-bleed unit not occupied by the tail unit of the shell or the fins is completely filled with some sort of appropriate inert, non-combustible or non-glutinous substance with low compressibility and very low inherent strength. Then the fin protector, provided it is completely sealed while attached to the shell, can be made of a relatively thin material giving the least possible dead-weight and requiring minimum space.

For example, there are certain bi-component silicones including some sold under the name SEALGAARD, that meet these requirements. Another conceivable substance would be a suitable fluid or a thixotrope.

With the fin protector under consideration filled in this way with such a non-compressible substance that completely surrounds the retracted fins it becomes possible to use a fin protector which, although the fin protector must be fully sealed, it is perfectly adequate for it to be made of small gauge (i.e. limited wall thickness) material as it will withstand extremely high external pressure without suffering deformation that would prevent ejection when the time comes and without any deformation of the enclosed fins. This means in turn that the driving band of the shell can be located at the optimal position irrespective of whether or not the fin protector and the retracted fins inside are located on the section of the shell that is most affected by the propellant gases. Deployment of the fins then requires only ejection of the fin protector in question after which the inherent spring force of the fins when initially convex in retracted mode, centrifugal forces, and/or air resistance forces the fins outwards to their deployed mode while simultaneously slinging the low inherent strength protective substance from the shell body and fins.

Even conventional artillery shells designed for firing in field guns and howitzers can be made surprisingly thin-walled provided that the rearmost section—primarily the shell cross-section where the driving band is located-which is exposed to the greatest forces is dimensioned sufficiently robustly. For shells designed to disperse bomblets and other types of submunitions where the shell itself is merely a cargo carrier, it is especially desirable that the inherent weight of the shell body is minimal. The present invention with its ejectable base-bleed unit housed in the tail unit of the shell enables appropriate parts of the base-bleed unit to be used as reinforcement for the cross-section of the shell where the driving band is located. The weight of this reinforcement can then be removed together with the base-bleed unit when they are no longer required. An especially advantageous version is shown in the example appended in which the inner aft wall of the base-bleed unit, i.e. the wall opposite the gas outlet which must have relatively heavy-duty dimensions, is used as reinforcement of the shell cross-section where the driving band is located. Provided that the location of the driving band is otherwise optimal a weight advantage is gained in the shell after the base-bleed unit has been ejected, and it is quite irrelevant if the inner wail of the base-bleed unit must be made excessively strong for this reason since the dead-weight in the shell has been otherwise reduced.

Figure 2:
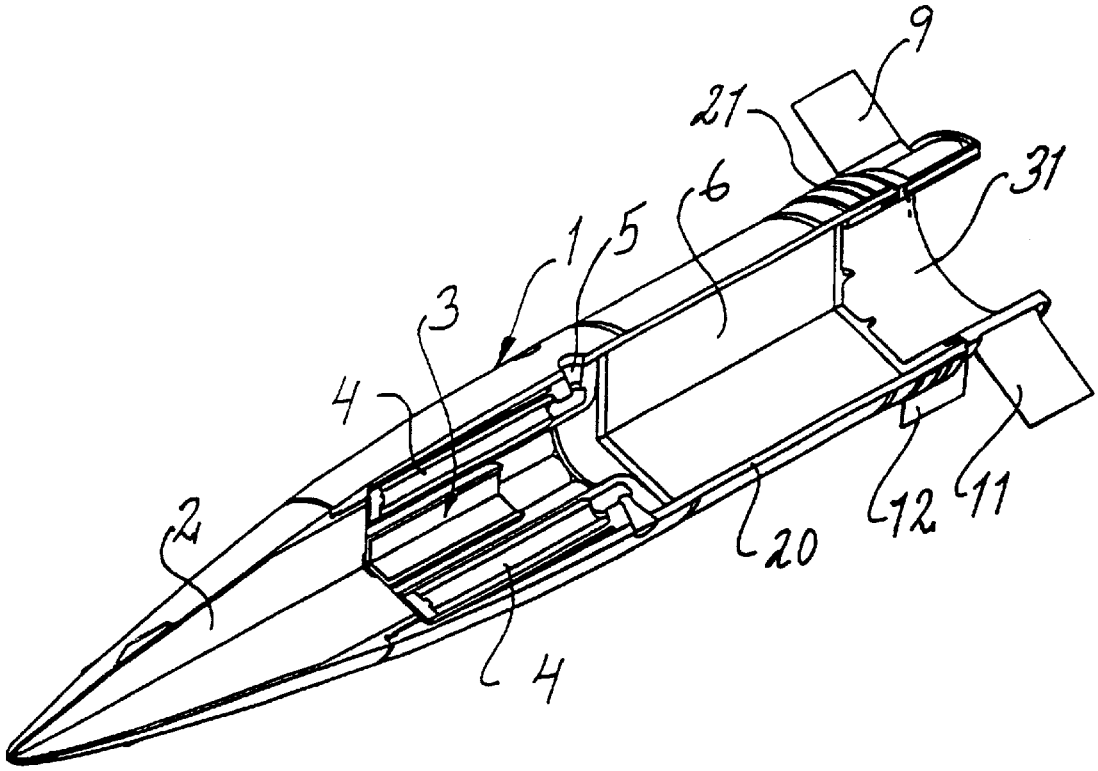
Figure 3:
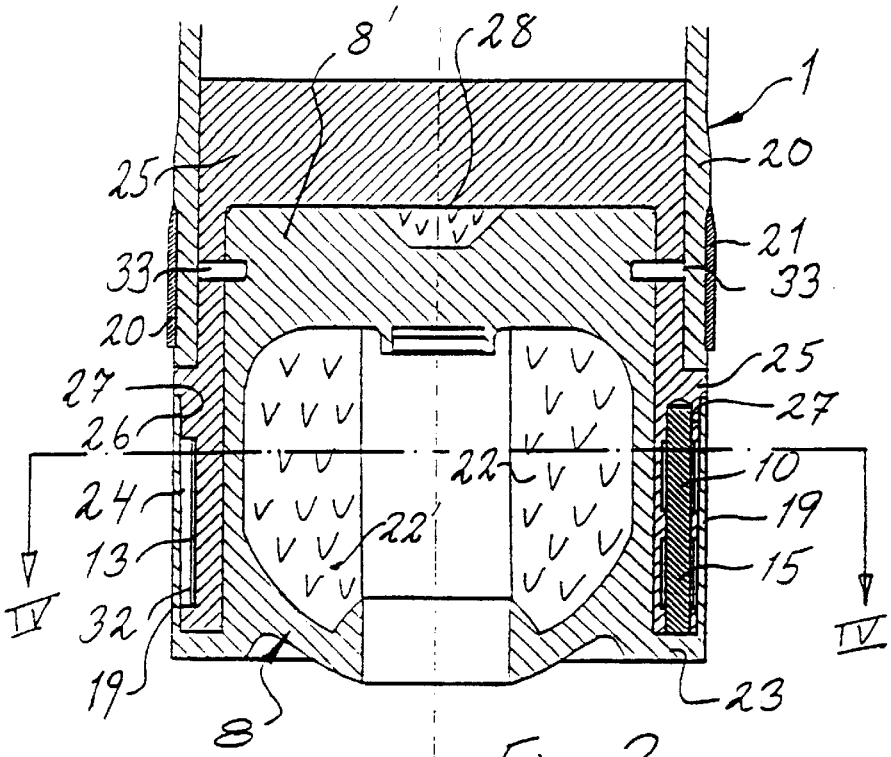
Figure 4:
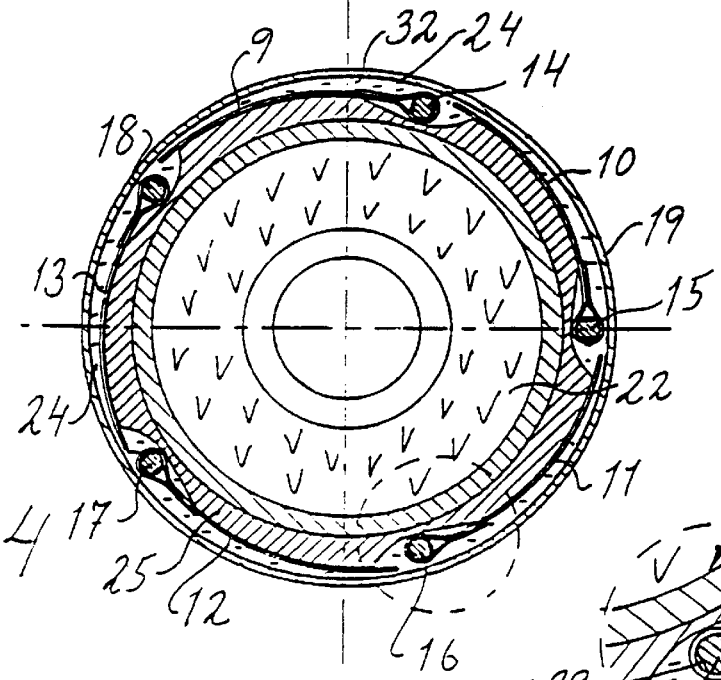
Figure 5:
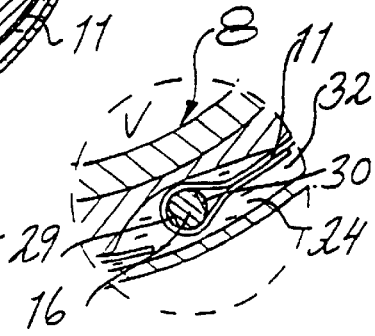
Figure 6:
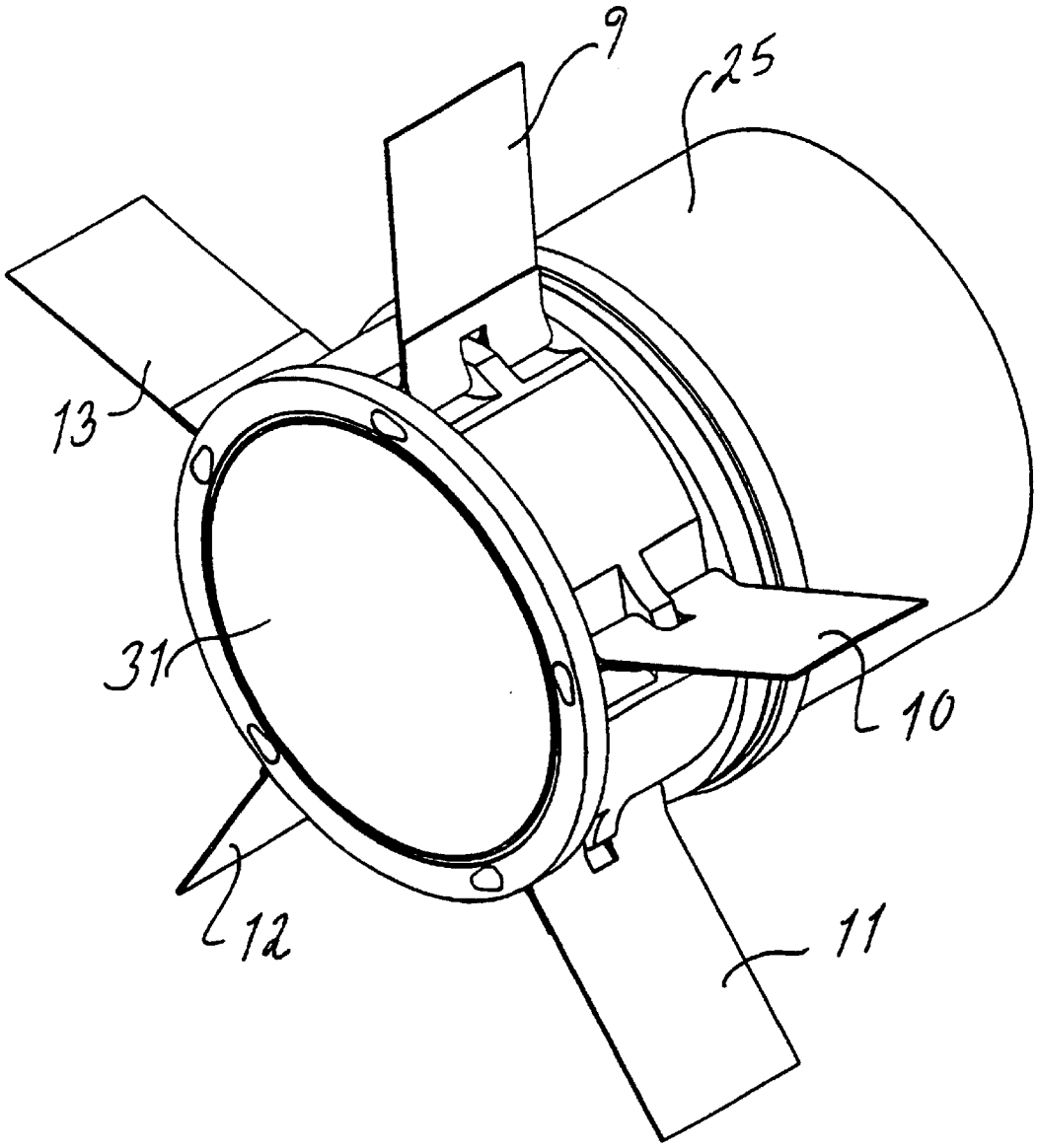

The present invention is defined in the following disclosure, and is described in somewhat more detail in the appended figures in which FIG. 1 shows a longitudinal section through an artillery shell of the type that could be relevant in connection with the present invention, while FIG. 2 shows the same shell after fin deployment, FIG. 3 is to a larger scale with more parts visible and shows a longitudinal section through the tail unit of the shell shown in FIG. 1, while FIG. 4 shows section IV—IV in FIG. 3. while FIG. 5 shows an enlargement of the circled sector marked in FIG. 4, and finally FIG. 6 shows an oblique projection of the aft housing of the shell (designated 25 in the figures) with all fins deployed. (Note that the shell body is not illustrated in this figure; only part 25 and the fins mounted therein are illustrated.)

Parts shown on more than one figure have the same designation irrespective of the scale used and the section illustrated.

The shell 1 illustrated in the figures is a TCM shell, i.e. a shell whose ballistic trajectory can be corrected while the shell is travelling towards its target (TCM=Trajectory Correctable Munitions). The main parts of the shell 1 are the electronics package 2 containing the electronics required for correcting the trajectory and other functions, a control unit 3 containing a number of propellant-driven thrusters 4 of known type which implement trajectory corrections as commanded by the electronics package, each such thruster incorporating a nozzle 5, aft of which there is a cargo section 6 for accommodating a cargo not described herein, such as bomblets/submunitions and finally a tail unit 7 containing primarily a base-bleed unit 8, fins 9–13 and their hinge pins 14–18. The complete shell also incorporates a base-bleed unit 8 and an integral fin protector 19.

FIGS. 2 through 5 show the fin protector fins, and base-bleed unit in more detail.

As illustrated in FIG. 2, for example, the shell 1 in the example in question has a relatively thin outer casing 20 and a driving band 21 made of copper or equivalent, and is otherwise constructed in accordance with conventional techniques. The relative thinness of the shell 1 body is primarily a direct result of the fact that the shell in question is designed to carry a number of bomblets/submunitions to the intended target, but this factor is of no significance in the context of the present invention. On the other hand, the design of the base-bleed unit 8 and the attached fin protector 19 is important. The base-bleed unit 8 is designed with an internal combustion chamber 22 which initially contains a slow-burning special propellant. The rear (relative to the direction of flight of the shell) wall of the base-bleed unit combustion chamber ends with a flange 23 which is integral with the fin protector 19, which in turn extends forwards in the direction of flight of the shell from the flange parallel with the outer wall of the base-bleed unit 8. Between this outer wall of the base-bleed unit 8, combustion chamber, and the inside of the fin protector 19 there is a ring-shaped space 24. Initially the base-bleed unit 8 is housed in the designated space 31 in the tail unit 7 of the shell 1. In the figures this space 31 for the base-bleed unit is in a separate aft housing 25 permanently integrated with the outer casing 20 of the shell 1. The aft housing 25 is similar in shape to a cylindrical can in whose outer rear wall the fins 9–13 are mounted via their hinge pins 14–18. The fins 9–13 are initially retracted against the outer curved surface of the outer wall of the aft housing 25, while those parts of the aft housing 25 in which the fins are mounted are recessed in the above mentioned ring-shaped space 24, and the inner surface of the fin protector 19 closest to the free overlap surface 26 forms a pull-off overlapping gas-tight seal with the sealing surface 27. The ring-shaped space 24 that is not occupied by the aft housing 25, the fins 9–13 and their hinge pins 14–18 are, in initial mode, filled with the above described inert and low inherent strength substance 32 which has the task of preventing the fin protector and fins from being deformed to such an extent that they can no longer perform their respective functions.

The space designated 28 in FIG. 3 contains a small base-bleed ejector charge which on command ejects the base-bleed unit 8, thereby also removing the integrated fin protector 19.

As shown in FIG. 3 the thickness of the homogeneous shell wall where the driving band 21 is located is considerable. The aft wall 8' of the base-bleed unit is similarly reinforced. The homogeneous material in this cross-section is critical as it is precisely this cross-section of the shell that is subjected to the greatest lateral load during firing.

Another detail worthy of mention is that the hinge pins of the fins each have two flat surfaces diametrically opposite each other which constitute two locking flats, designated 29 and 30 in FIG. 5, radial to the cross-section of the shell. By pre-tensioning the fold of the fins around their respective hinge pins so that the sheet metal of each fin has a spring force that pinches the fold of the fin around each hinge pin, the locking flats provide an elementary but adequate locking of the fins in deployed mode after they have swung out by pivoting around the stationary hinge pins.

The base-bleed unit 8 is secured in the aft housing 25 of the shell 1 by shear pins 33 that shear off when the gas generating ejector charge 28 is activated. As the fin protector 19 is integral with the base-bleed unit 8 there is no need for a separate securing device for the former.

We claim:

1. A method for a shell equipped with a base-bleed unit for achieving maximal range and which at least during a final phase of its trajectory is fin-stabilized by fins deployable from a body of said shell, said method comprising the steps of:

providing said base-bleed unit with an integral fin protector that surrounds said fins while said fins are retracted prior to deployment; and ejecting said base-bleed unit and said fin protector together from said shell, to free said fins for deployment during a flight of said shell.

2. The method of claim 1, wherein the ejection of the base-bleed unit and the fin protector is actuated by a gas generating ejector charge located between the base-bleed unit and an aft wall of the shell.

3. A shell incorporating a base-bleed unit to obtain maximal range and which at least during a final phase of its trajectory is fin-stabilized by fins deployable from a body of said shell, comprising:

a housing containing said base-bleed unit;

a gas-generating ejector charge for ejecting the base-bleed unit on command, said ejector charge being located between said base-bleed unit and an aft wall of said housing;

said fins, when not deployed, being retracted within a space between a fin protector and said housing, said fin protector being integral with said base-bleed unit;

wherein said ejector charge ejects said base-bleed unit and fin protector together to free said fins for deployment during a flight of said shell.

4. The shell of claim 3, wherein a space between said base-bleed unit and fin protector is ring-shaped and open forwards in a direction of said flight of the shell and in which the housing, including the fins mounted therein and against which said fins are retracted, is inserted.

5. The shell of claim 4, wherein a space inside said ring-shaped space not occupied by the housing of the shell and the fins and mounts of said fins is completely filled with a non-glutinous substance of low inherent strength and low compressibility.

* * * * *